US011278760B1

(12) United States Patent
Hutchinson

(10) Patent No.: US 11,278,760 B1
(45) Date of Patent: Mar. 22, 2022

(54) PHYSICAL REHABILITATION AND EXERCISE DEVISE

(71) Applicant: Merrill Hutchinson, West Harrison, IN (US)

(72) Inventor: Merrill Hutchinson, West Harrison, IN (US)

(73) Assignee: Merrill Hutchinsonn, West Harrison, IN (US)

( * ) Notice: Subject to any disclaimer, the term of this patent is extended or adjusted under 35 U.S.C. 154(b) by 131 days.

(21) Appl. No.: 16/713,149

(22) Filed: Dec. 13, 2019

Related U.S. Application Data

(60) Provisional application No. 62/907,900, filed on Sep. 30, 2019.

(51) Int. Cl.

| | |
|---|---|
| ***A63B 21/00*** | (2006.01) |
| ***A63B 21/072*** | (2006.01) |
| ***A63B 15/00*** | (2006.01) |
| ***A63B 24/00*** | (2006.01) |
| ***A63B 71/06*** | (2006.01) |

(52) U.S. Cl.
CPC ..... *A63B 21/4035* (2015.10); *A63B 15/00* (2013.01); *A63B 21/072* (2013.01); *A63B 24/0062* (2013.01); *A63B 71/0619* (2013.01); *A63B 2225/093* (2013.01); *A63B 2225/52* (2013.01)

(58) Field of Classification Search
CPC . A63B 21/4035; A63B 15/00; A63B 24/0062; A63B 21/072; A63B 71/0619; A63B 2225/093; A63B 2225/52; A63B 21/4047; A63B 21/06; A63B 23/03508; A63B 23/03541; A63B 23/047; A63B 21/0728; A63B 22/0005; A63B 22/0012; A63B 22/02; A63B 22/203; A63B 23/1209; A63B 2069/0033; A63B 2071/0018; A63B 2208/0204; A63B 2208/0233; A63B 2208/0238; A63B 21/0004; A63B 21/0602; A63B 21/0618; A63B 21/08; A63B 21/4043; A63B 2209/00; A63B 2225/68; A45B 3/00; A45B 9/04; A45B 2200/055
See application file for complete search history.

(56) References Cited

U.S. PATENT DOCUMENTS 3,587,319 A * 6/1971 Andrews ..... A63B 21/4047 482/112
3,957,266 A * 5/1976 Rice ..... A63B 21/015 482/91
5,013,034 A * 5/1991 March ..... A63B 21/015 482/115

(Continued)

*Primary Examiner* — Andrew S Lo
(74) *Attorney, Agent, or Firm* — Nathan Potter; Kurt Summe

(57) ABSTRACT

An exercise device allows a user to move the mass of weights in various directions while mitigating the downward force of gravity on the weights. A telescoping pole includes a platform that supports weight plates in place during exercise, and may be assembled at different lengths depending upon the height of the user. A handle may be coupled to the telescoping pole to hold the weights on the platform and provide varying grips. The telescoping pole may be inserted into and moveably engaged with a base portion that holds a lower portion of the exercise device at a static position within the base while the handle is moved in varying directions.

17 Claims, 13 Drawing Sheets

(56) References Cited

U.S. PATENT DOCUMENTS

| | | | | |
|---|---|---|---|---|
| 5,207,624 | A * | 5/1993 | Paskovich | A63B 21/072 482/106 |
| 5,244,444 | A * | 9/1993 | Wostry | A63B 21/0615 482/109 |
| 5,628,713 | A * | 5/1997 | Wilkinson | A45B 3/00 482/51 |
| 7,115,078 | B1 * | 10/2006 | Kalember | A63B 21/015 482/117 |
| 8,636,630 | B2 * | 1/2014 | Morris | A63B 21/4047 482/117 |
| 8,974,354 | B1 * | 3/2015 | Nelson | A63B 21/16 482/94 |
| 8,979,720 | B2 * | 3/2015 | Brentham | A63B 21/4035 482/112 |
| 2003/0013586 | A1 * | 1/2003 | Rothschild | A63B 23/03541 482/117 |
| 2005/0176558 | A1 * | 8/2005 | Huang | A63B 21/0616 482/93 |
| 2006/0105890 | A1 * | 5/2006 | Logue | A63B 21/0724 482/106 |
| 2007/0184941 | A1 * | 8/2007 | Krietzman | A63B 21/4047 482/93 |
| 2007/0184942 | A1 * | 8/2007 | Krietzman | A63B 21/072 482/93 |
| 2008/0234116 | A1 * | 9/2008 | Elzerman | A63B 21/045 482/123 |
| 2017/0072241 | A1 * | 3/2017 | Pena-Ruiz | A63B 21/0087 |
| 2018/0255885 | A1 * | 9/2018 | Sarazen | A45B 9/04 |
| 2018/0264312 | A1 * | 9/2018 | Pompile | A63B 23/1281 |
| 2019/0105528 | A1 * | 4/2019 | Bardakci | A63B 21/012 |

* cited by examiner

PHYSICAL REHABILITATION AND EXERCISE DEVISE

CROSS REFERENCE TO RELATED APPLICATIONS

This application claims the benefit of U.S. Provisional Patent Application No. 62/907,900, filed Sep. 30, 2019, and titled "Full Body Physical Rehabilitation and Exercise Device," the entire disclosure of which incorporated by reference herein.

TECHNICAL FIELD

This disclosure pertains to physical therapy devices, medical devices, and exercise devices.

BACKGROUND

Many people suffer from pain, muscle weakness, and/or loss of motion in joints ("exercise-limiting conditions") in the arm, leg, hip, shoulder, core muscles (the common name for a complex of muscles including the Rectus Abdominus, Obliques, Erector Spinae, Transverse Abdominus, and Quadratus Lumborum), and/or spine. There are several causes of exercise-limiting conditions including physical injury, disease, and old age.

Physical rehabilitation and exercise devices are often used as treatments for injuries or medical conditions. However, some exercises or exercise equipment may prove unsuited to a user's exercise-limiting condition. Additionally, some exercise motions may be so complex that a specialized machine may be needed to allow a user with an exercise-limiting condition to correctly perform the exercise's motion.

BRIEF SUMMARY

Embodiments of the present device are used to improve range of motion, increase strength, and create muscle memory. These devices can be set to a desired height, loaded with a desired weight load, and used to perform complex exercise motions on a horizontal plane while providing mass-based resistance in any direction on that plane and significantly mitigating gravity's effect on the weight.

Examples described herein and variations of such provide a number of advantages. As an example, variations on the disclosed exercise devices combine the ability to adjust the device to a desired height, select a desired weight load, and allow a user to perform even complex exercise motions while the structure of the claimed device significantly influences the effect of gravity on the weight. As another example, variations on the disclosed device are relatively simple compared to large cable-based exercise equipment and occupy a relatively small space in a home or exercise facility. As another example, variations on the disclosed device may be easily set up for use and disassembled for storage and do not require permanent placement, assembly, or attachment to floors, walls, or other structures. Other advantages exist and will be apparent to those of ordinary skill in the art in light of this disclosure.

BRIEF DESCRIPTION OF THE DRAWINGS

Drawings are exemplary and are not intended to be limiting. Variations possible would be clear to those skilled in the art. A detailed description of the present disclosure is hereafter described with specific reference to the drawings.

DETAILED DESCRIPTION

Figure 1:
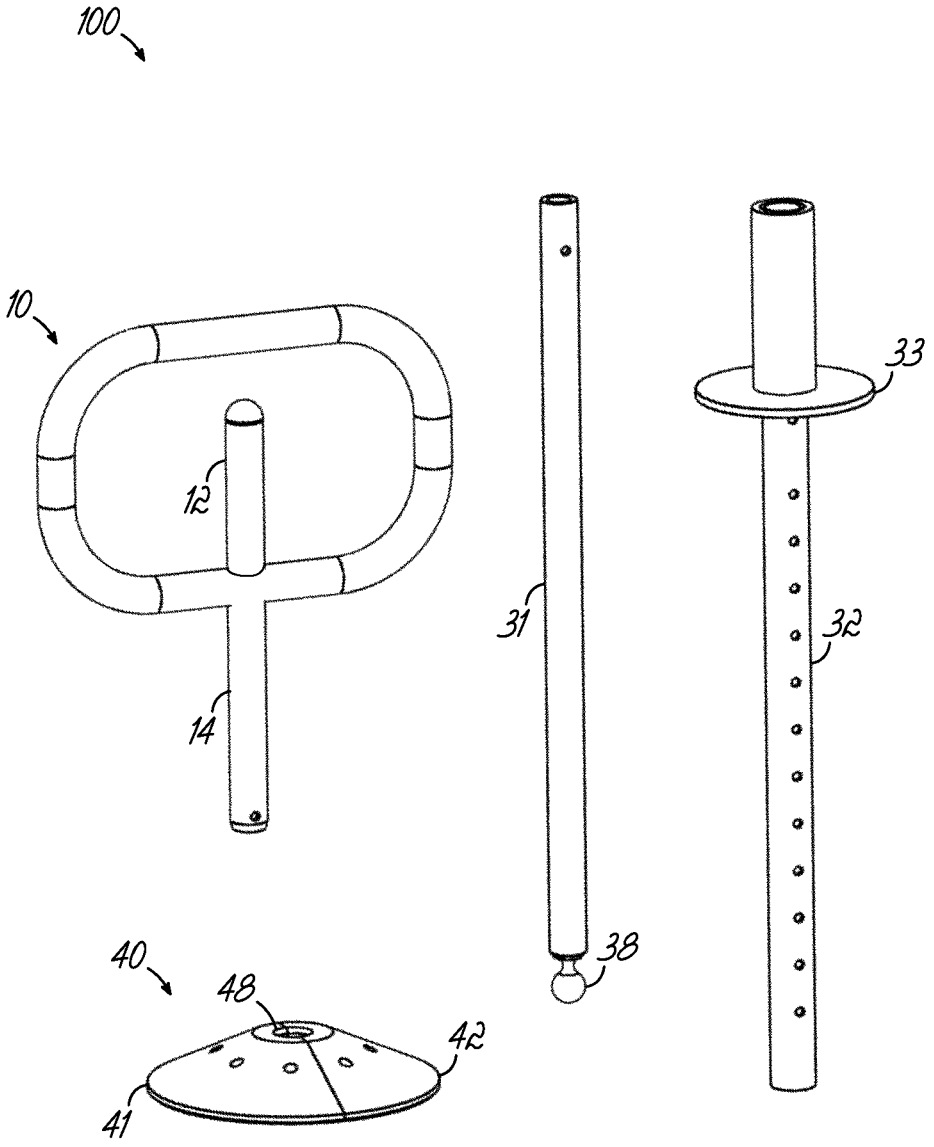
FIG. 1 shows a perspective view of an exemplary exercise device in a disassembled form.

FIG. 1 shows a disassembly of components of an embodiment of the present disclosure. An exercise device 100 is shown in disassembled form including a handle 10 with a handle pole 14, an outer sheath portion 32, an inner pole 31 including a base connector shown as a spherical bearing 38 on the bottom end, and a base 40 having a receiver 48. The components of an exercise device according to FIG. 1 are only of one embodiment and FIG. 1 is not intended to limit the substitution or addition of components selected by one skilled in the art to build the claimed device.

Figure 2:
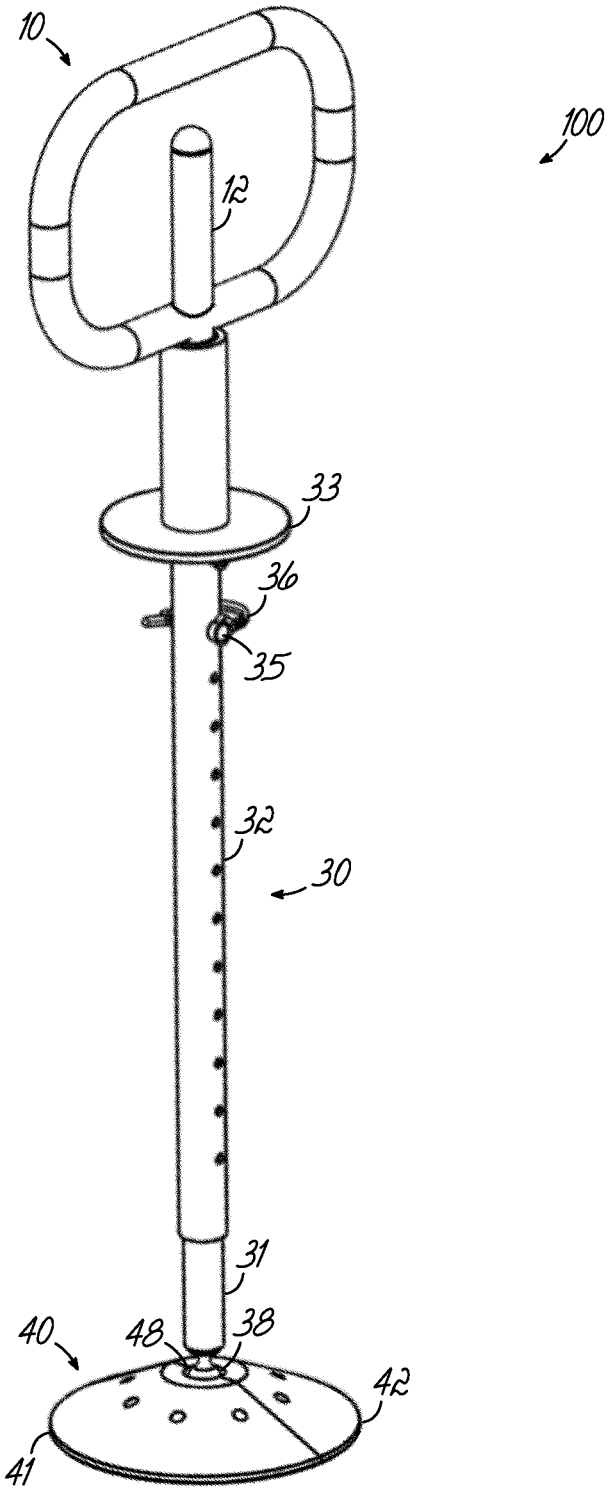
FIG. 2 shows a perspective view of the exercise device of FIG. 1.
Figure 3:
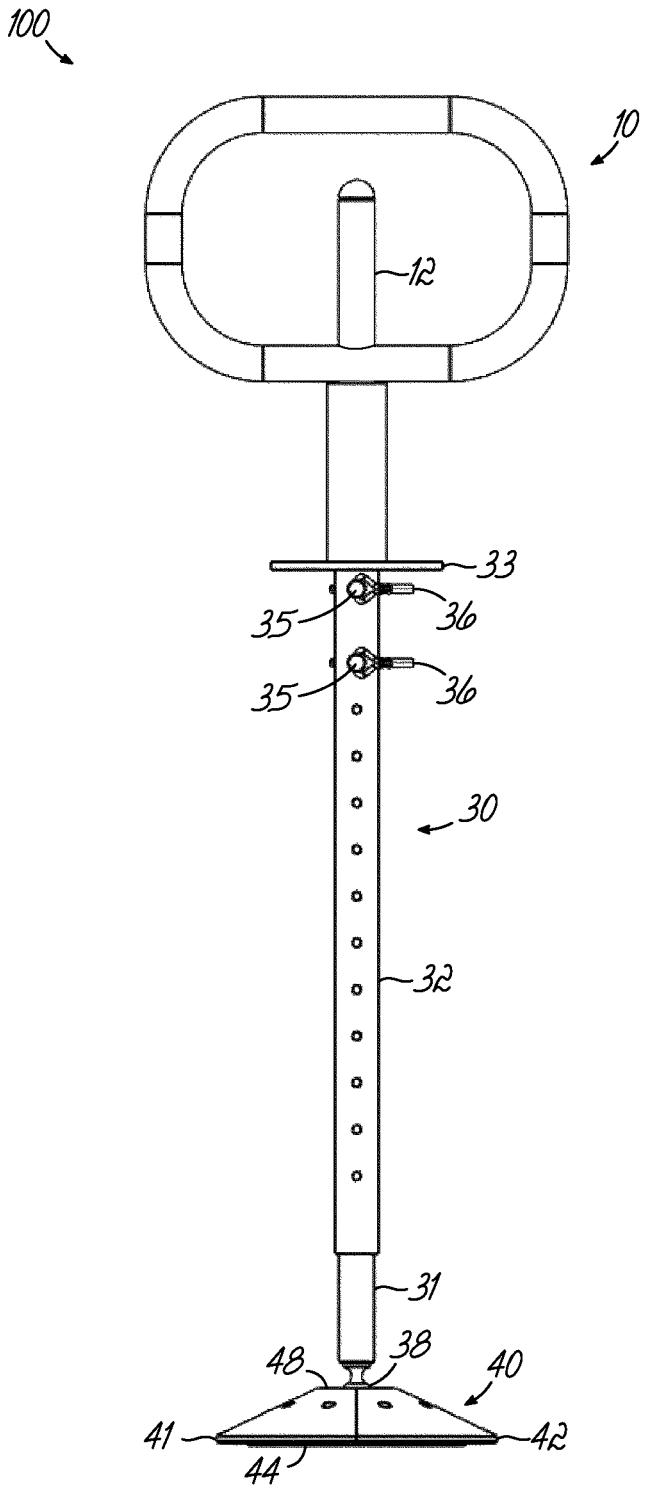
FIG. 3 shows an elevation view of the exercise device of FIG. 1.

FIGS. 2 and 3 show the exercise device from FIG. 1 in an assembled form. The handle pole 14 has been inserted into a top end of the sheath portion 32 and the inner pole 31 has been inserted into the bottom end of the sheath portion 32. The spherical bearing 38 of the inner pole 31 has been inserted into the receiver 48. The assembled handle 10, sheath portion 32, and inner pole 31 may be held together by fasteners, clips, bolts, or other fastening means that couple the handle 10 and the inner pole 31 to the sheath portion 32, and that maintain a substantially static relationship between coupled components during use.

As an example, FIG. 3 shows two pins 35 inserted into one side of the outer sheath 32, such that a first clip passes through the outer sheath 32 and the handle (10), and a second clip passes through the outer sheath 32 and the inner pole 31. As can be seen, the sheath portion 32 may include a number of fastener holes that may be used to position and couple the attached components at a desired position, providing a variable length assembly. In some embodiments, the telescoping pole is fashioned to extend from about three feet long to about six feet long in order to accommodate the height of the user and the exercise motion the user wishes to perform. While the exercise device shown in FIGS. 2 and 3 is secured by pins 35, any suitable fasteners, including screws and nuts, quick-release pins, rubber pegs, and unthreaded rods with rubber stoppers, may be used to secure the handle 10 and the inner pole 31 to the outer sheath 32.

The fasteners should be adapted to secure the inner pole 31 and the handle 10 to the outer sheath 32 and be durable enough to withstand the pressure of the weights during the exercise device's use in order to prevent shearing or failure. When assembling the device, the user starts by securing the inner pole 31 to the outer sheath 32 with a fastener. Before securing the handle 10 to other sheath 32, the user places weight plates, such as Olympic or standard weight plates, on the platform 33. Weight plates are placed on the platform 33 by sliding the weight over the top end of the outer sheath 32 and resting the plate on the platform 33.

The platform 33 depicted in FIGS. 1-3 shows an additional sheath attached to the platform 33 that is adapted so that the weight plates are secured during use by having the diameter of the hole in the center of the weight plates snugly fit over the diameter of the sheath connected to the platform 33. This prevents damage and unwanted shifting of the weight. After putting weight plates on the platform 33 to reach the desired weight load, the user will secure the handle 10 to the outer sheath 32 with a fastener. The combined handle 10, sheath portion 32, and inner pole 31 produce a telescoping pole 30. Finally, the user will couple the telescoping pole 30 with the receiver 48 of the base 40. The assembly of the telescoping pole 30 ensures that the downward force of gravity on the exercise device and weights are substantially negated by the base 40 and the floor or any other piece of equipment or structure adapted to support the base 40, as the weight of plates (e.g., the downward force due to gravity) resting upon the platform 33 will be transmitted through the telescoping pole 30 to the base 48, and to whatever surface the base 48 rests upon.

Figure 4:
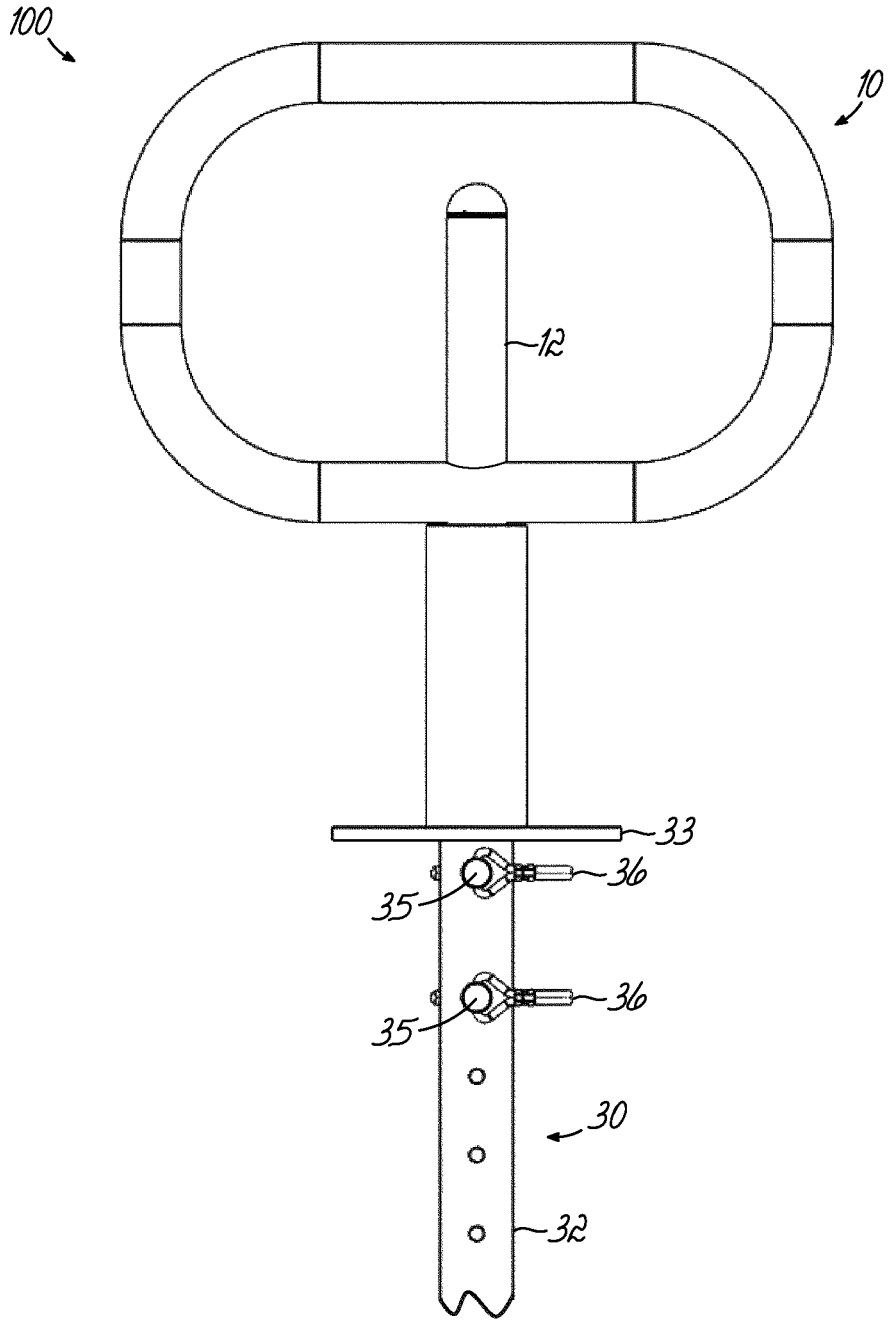
FIG. 4 shows a magnified view of FIG. 3, focusing on a handle portion.

FIG. 4 shows a close-up of the upper portion of the exercise device depicted in FIG. 3. In some embodiments, the handle 10 includes an outer looping portion (e.g., a loop grip) and a rod portion 12 (e.g., a post grip) that allow for grips during use (e.g., overhand, underhand, horizontal, vertical). The handle 10 depicted in FIG. 4 is only one example of a handle, other embodiments include handles shaped like kettle bell handles, D-ring grips, and curved handles. In some embodiments, the platform 33 is attached to the outer sheath 32 and supports the weight or weights. In other embodiments the platform 33 is supported by a fastener that couples with the holes along the outer sheath 32, so that the platform 33 itself may be positioned at variable locations along the telescoping pole 30 relative to the handle (e.g., to produce varying mechanical advantages or disadvantages as the handle 10 is used to push, pull, rotate, or otherwise move the upper end of the telescoping pole like a lever).

In some embodiments, the pins 35, or other fasteners, that are used to connect the handle 10 to the outer sheath 32 and the inner pole 31 to the outer sheath 32, are further secured by retainers 36. In some embodiments, the retainer 36 is attached to the pin 35 and wraps around the outer sheath 32 before being secured to the opposite end of the pin 35. In other embodiments, the handle pole has a screw threaded exterior and the top end of outer sheath has an interior screw threaded receiver that is adapted to couple with the screw threaded exterior of the handle pole. In this embodiment, the handle pole is inserted into the adapted receiver of the top end of the outer sheath and then rotated until the handle is satisfactorily secured to the outer sheath.

Figure 5:
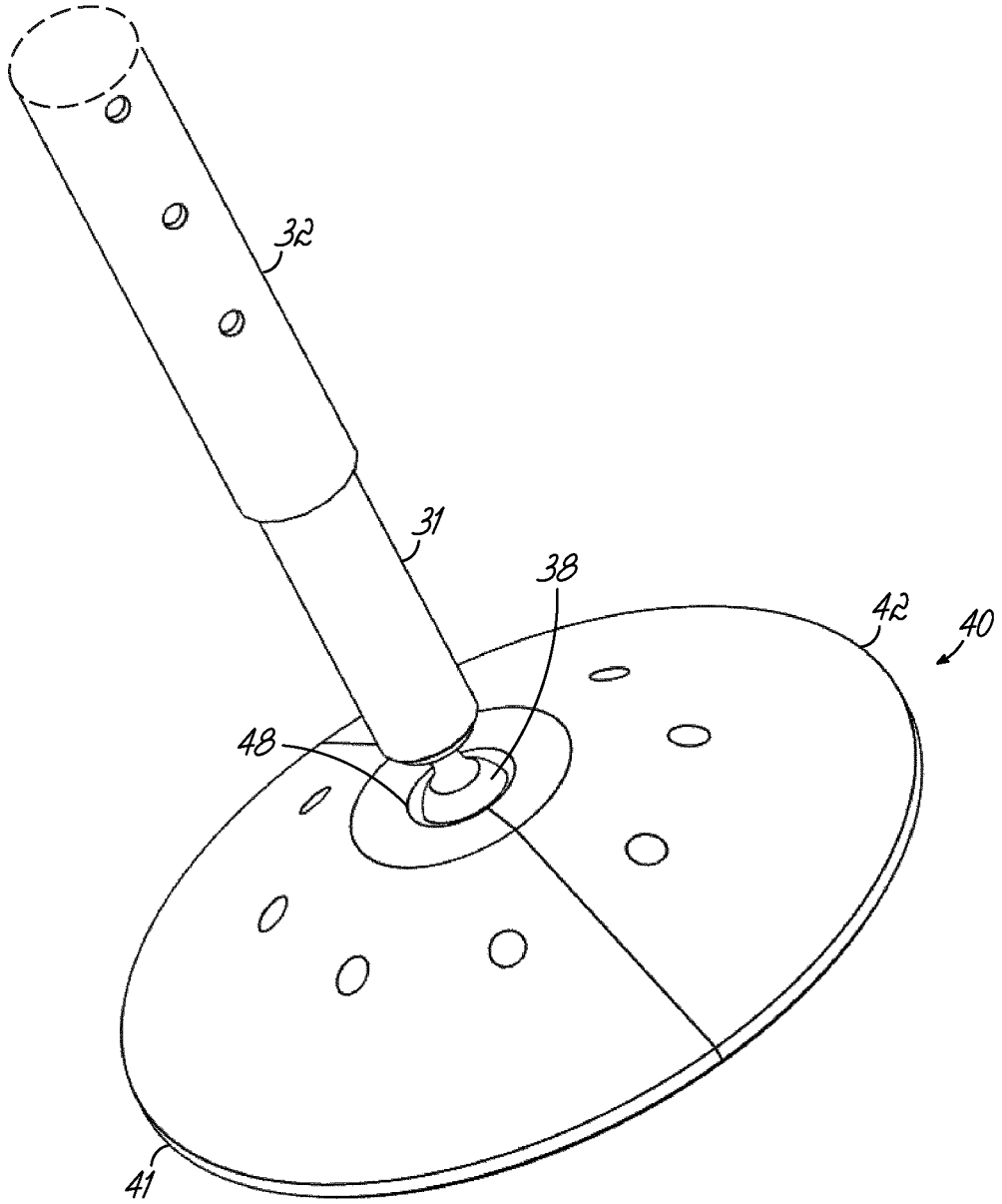
FIG. 5 shows a magnified view of FIG. 2, focusing on a base portion.

FIG. 5 shows a close-up of the bottom portion of the exercise device depicted in FIG. 3. In some embodiments, the spherical bearing 38 at the bottom end of the inner pole 31 is movably inserted into the receiver 48 of the base 40. In some embodiments, the telescoping pole 30 is freely removable from the receiver 48 of the base 40 (e.g., the diameter of the receiver 48 is larger than that of the spherical bearing 38). In other embodiments, the telescoping pole 30 is semi-permanently attached to the base 40 (e.g., the diameter of the receiver 48 is smaller than that of the spherical bearing 38, and the base 48 is manufactured or assembled to retain the spherical bearing 38 during normal use).

In yet other embodiments, the spherical bearing 38 is temporarily and movably fixed within the receiver 48 of the base 40 by assembling the receiver 48 around the spherical bearing 38 and securing the coupling with screws or other fasteners in the base 40. Those skilled in the art may employ other techniques of loading the spherical bearing 38 into the receiver 49, while still maintaining the movability of the telescoping pole 30. While the exercise device depicted in FIG. 5 includes a spherical bearing 38 movably coupled to the receiver 48 of the base 40, creating a ball joint, other embodiments of the exercise device include attaching a telescoping pole to a base a using a spherical rolling joint, a universal joint, a constant-velocity joint, or other type of joint that allows the user to perform exercise motions with a desirable number of degrees of freedom and rotation.

While FIG. 5 shows a coupling that creates a ball joint, this is not intended to limit the type of joint one skilled in the art would use to accomplish the purpose of the claimed device. Specifically, the joints with similar ranges of motion to the claimed device is fashioned to allow the telescoping pole to be movable in any direction on a horizontal plane. Joints with similar ranges of motion may be able to move about 180 degrees or more using the receptacle of the base as the pivot point. In some embodiments, the top of the telescoping pole starts at a position laying on the ground while the bottom of telescoping pole remains coupled to the base and a user may leverage the telescoping pole to the upright position and then lay the telescoping pole on the ground opposite its original position in relation to the base. In some embodiments, the telescoping pole may be rotated in a yaw about the axis created when the telescoping pole is perpendicular with the bottom of the base.

The particular form and manner in which the telescoping pole 30 is coupled to the receiver 48 may be varied based upon the desired application for a device, and may include other consideration such as cost, complexity, safety, and usability. As an example, while some implementations may use a spherical bearing 38 due to simplicity and flexibility, others may use a hinge joint or other coupling that limits range of motion within a desired area, such that a hinged joint may be preferable for exercise related to some shoulder injuries, while a ball joint may be preferable for a wide range of exercises but may allow for undesirable range of motions for those with shoulder injuries.

Figure 6:
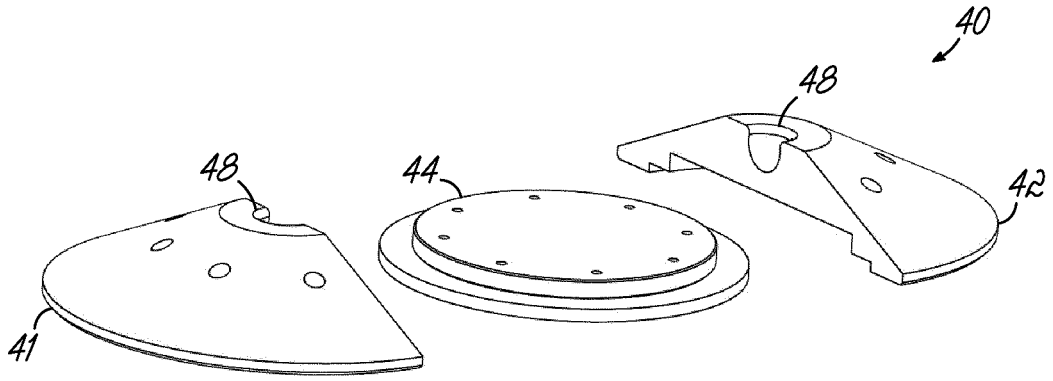
FIG. 6 shows a perspective view of an exemplary base of the exercise device of FIG. 1 in a disassembled form.

FIG. 6 shows a disassembled view of the base 40 of the exercise device of FIG. 5. In some embodiments, the base 40 includes a bottom plate 44 and two half-conical plates 41, 42 that are coupled to create a receiver 48 for the spherical bearing 38 at the bottom end of the inner pole 31. In some embodiments, the two half-conical plates 41, 42 are coupled to the bottom plate 44 with fasteners including screws, pegs, rivets, and clips. The coupling of the two half-conical plates 41, 42 to the bottom plate 44 may create a receiver 48 that is capable of supporting the force generated by the weight of the telescoping pole 30 and any weights placed on the platform 33 during the exercise motions.

Figure 7:
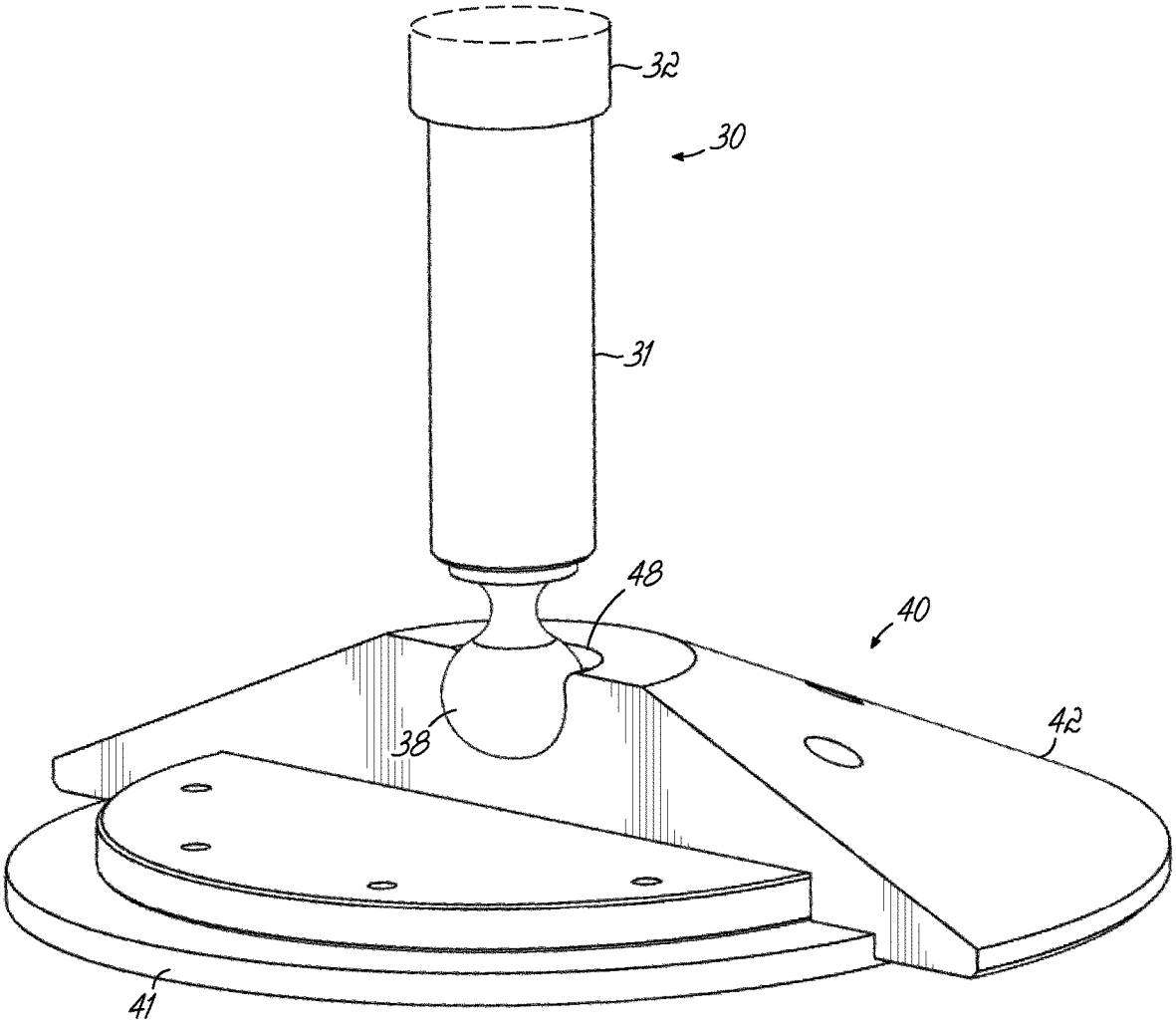
FIG. 7 shows the base of FIG. 6 in a partially assembled form.
Figure 7A:
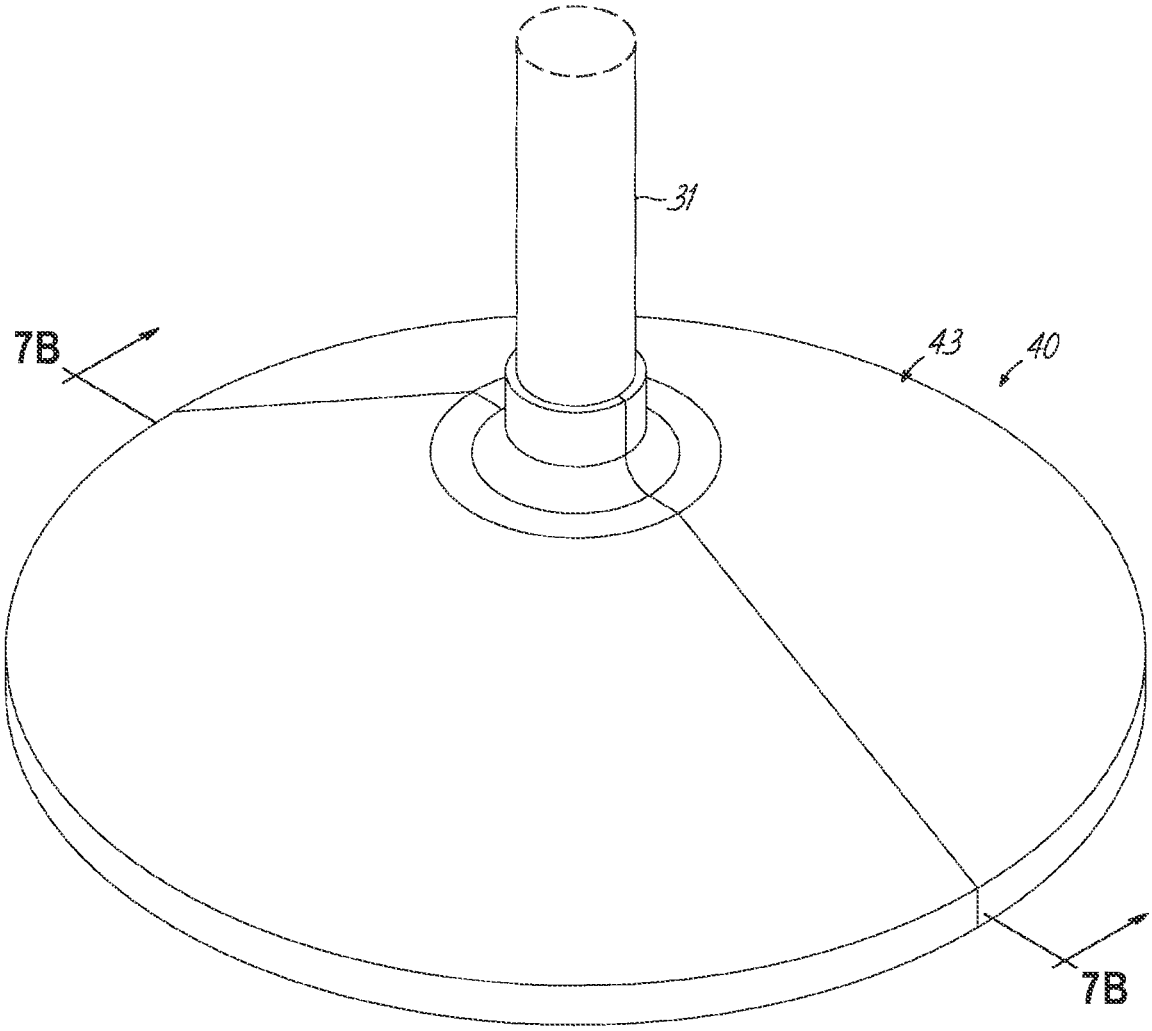
FIG. 7A is a perspective view of a base with a cover.
Figure 7B:
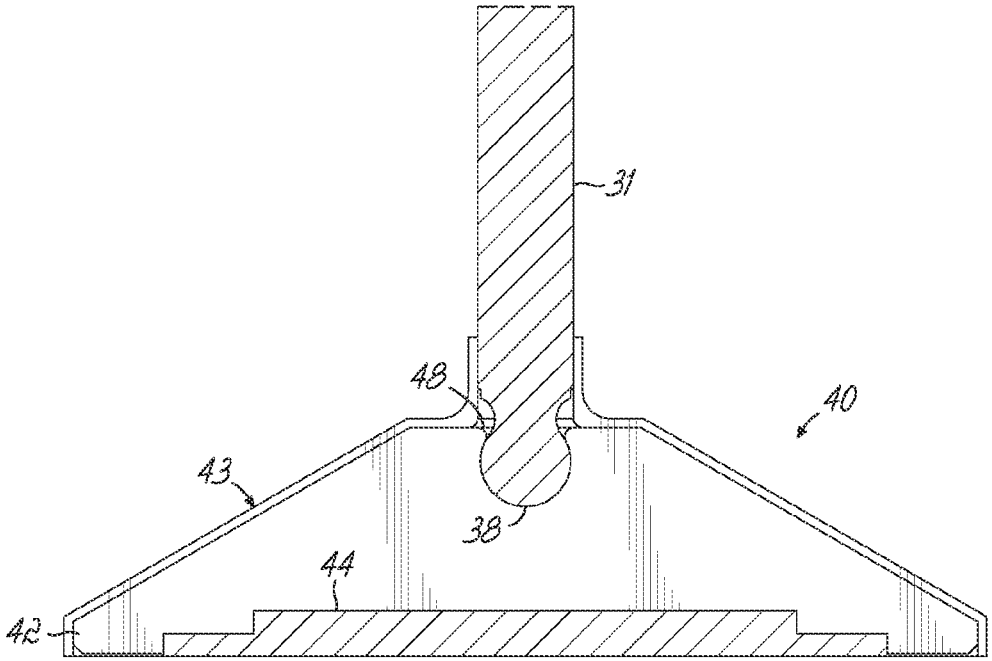
FIG. 7B is a cross-sectional view of a base with a cover.

FIG. 7 shows a partially assembled view of the exercise device depicted in FIG. 5. In some embodiments, the spherical bearing 38 at the bottom end of the inner pole 31 is movably coupled with the receiver 48 of one half-conical plate 42. In the shown exercise device, the spherical bearing 38 is not removable from the combined receiver 48 once both half-conical plates 41, 42 are coupled with the bottom plate 44. Further, in some embodiments, the based is fashioned in a way that it remains stationary while the device is in use. This may be accomplished by the mass of the base, a coupling mechanism with the floor or other equipment, a concave bottom side of the base that creates a vacuum between the base and the floor when force is applied to the device, or any other means known to those skilled in the art. In some embodiments, the inner pole 31 has a screw cap that has an opening that is wide enough to be moved down the length of the inner pole 31 but the spherical bearing 38 has a larger diameter than the opening of the screw cap. This embodiment allows the screw cap to couple with an adapted receiver 48 of the base 40 so that the telescoping pole 30 is not removable from the base 40 without first uncoupling the screw cap. The screw cap embodiment is particularly useful for an exercise device that is used at higher weight loads, where the screw cap will prevent undesired movement of the joint created by the coupling of the telescoping pole 30 and the base 40. Such embodiments may also provide holes or mounting points that allow the base 40 to be screwed or otherwise coupled to the floor or other surface upon which it rests. In some embodiments, a position locking mechanism 43 is attached to the base and couples to the handle, platform, or telescoping pole to prevent the telescoping pole from moving while the device is not in use (e.g., such as a cover 43 that fits the top of the base 40 and isolates movements of the telescoping pole 30 to maintain it at a neutral position). Embodiments with this position locking mechanism are useful for storage purposes in a user's home or in a rehabilitation or exercise facility because the locked-position exercise device is easier to store and more quickly set up for use.

Figure 8:
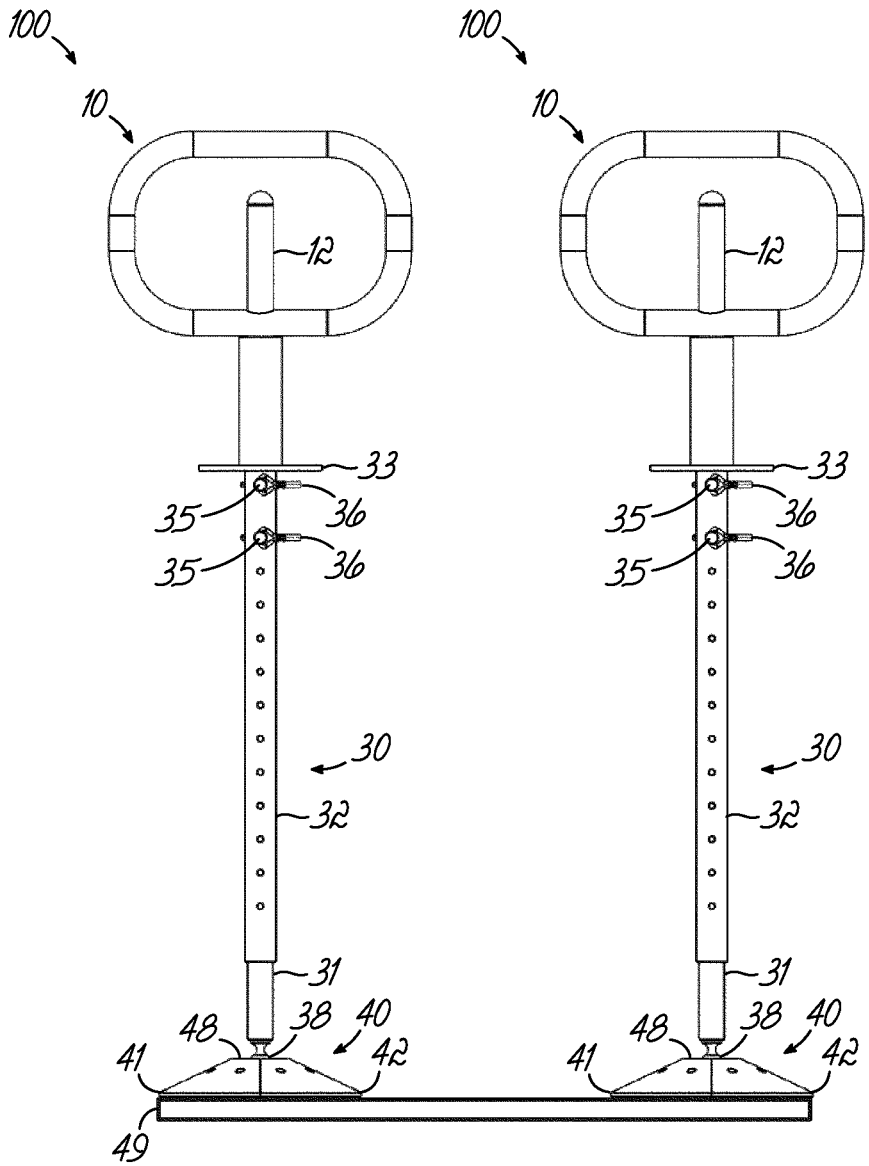
FIG. 8 shows an elevation view of two of the exercise devices of FIG. 1 placed on a baseplate for use with both arms.

FIG. 8 shows an embodiment including two exercise devices from FIG. 7 coupled to an extended base 49. In some embodiments, the user will use two exercise devices at a set distance apart so that the user benefits from performing exercise motions that involve using both of the user's hands, wrists, arms, or shoulders at the same time. The base 40 of each device may be coupled to the base 49 to prevent unintended movements or sliding during use, and the extended base 49 may be attached to the floor, may freely rest upon the floor, or may extend in one or more directions to provide a broad base that prevents tipping or that may stood upon by a user while the two exercise devices are used.

Figure 9:
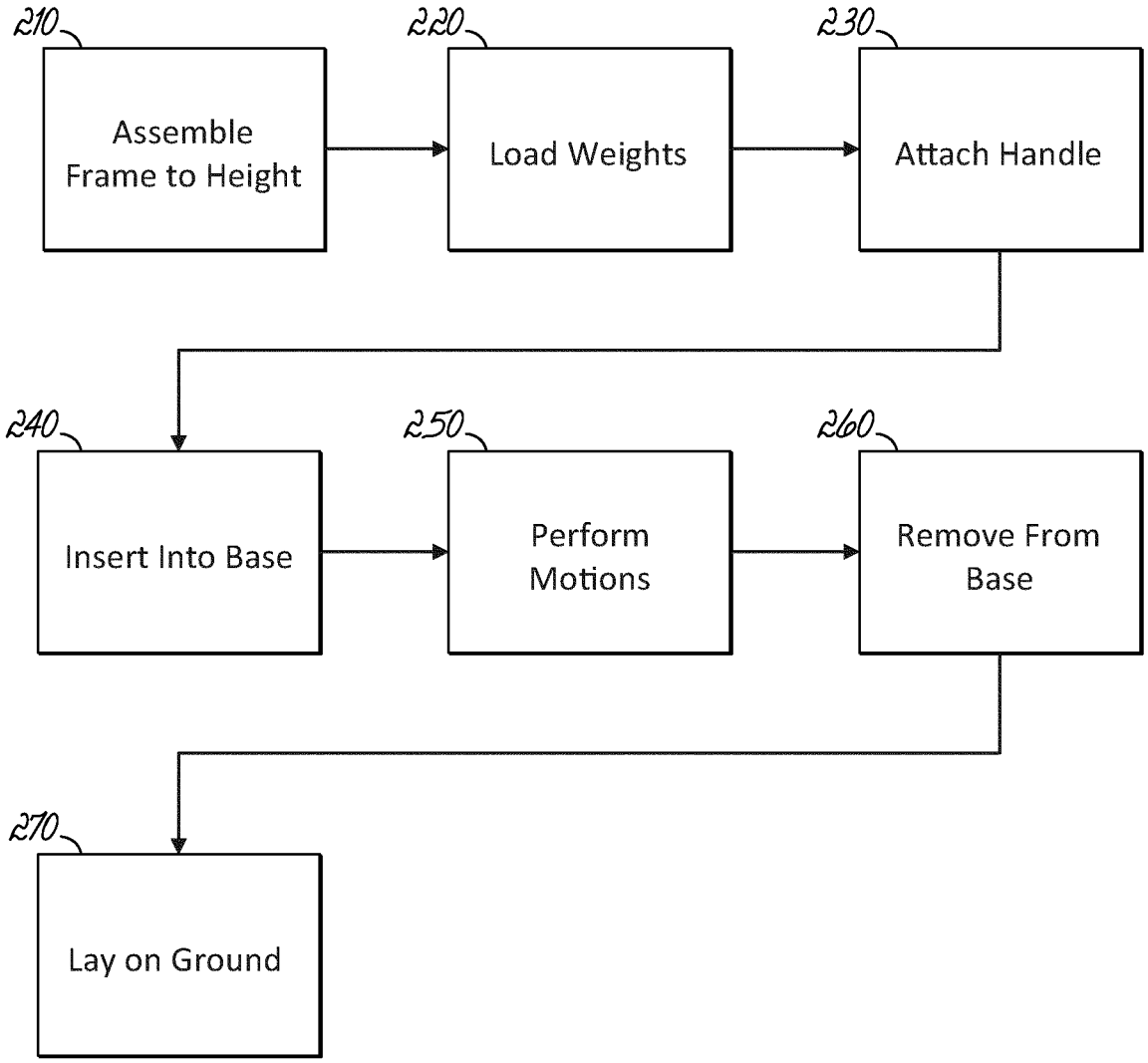
FIG. 9 shows a flowchart of an exemplary set of steps that may be performed to assemble and use the exercise device of FIG. 1.

FIG. 9 provides a flowchart of a set of steps that may be performed to assemble, use, and store an exercise device such as that of FIG. 1. The user begins assembling the frame to the user's desired height 210 by inserting and securing the inner pole 31 at the user's desired position within the outer sheath 32 using a fastener (e.g., such as the pin 35 and retainer 36). The user then adds the weight or weights to the device 220 by sliding a hole in the center of the weight over the top of the outer sheath 32 and resting the weight on the platform 33. Next, the user attaches the handle 230 by inserting the handle pole 14 into the outer sheath 32 and securing the handle 10 within the outer sheath 32 by using at least one pin 35 and one retainer 36. The user then inserts 240 the assembled telescoping pole 30 into the base 40 by movably coupling the spherical bearing 38 of the inner pole 31 with the receiver 48 of the base 40. In some embodiments, a screw cap is used to fasten the telescoping pole 30 to the base 40 after inserting the spherical bearing 38 into the receiver 48. In other embodiments, the user does not need to couple the telescoping pole 30 to the base 40 because the telescoping pole 30 is permanently or semi-permanently fixed within the receiver 48 of the base 40. Finally, the user performs his or her desired exercise motions 250 using the fully assembled device.

While performing 250 the desired exercises, the user will be moving the mass of the weights along curves and primarily along a horizontal plane, with some movement along a vertical plane throughout the curve. During performance 250 of the exercises, the effect of gravity on the weights will be entirely or substantially transmitted through the base 40 and into the floor, depending upon the extent to which the handle 10 has been moved from the neutral position (e.g., if the handle 10 is pulled towards a user the perceived effect of gravity will gradually increase).

Once the user is finished performing his or her desired exercise motions, the user will remove the telescoping pole 30 from the base 260 either by lifting the telescoping pole 30 out of the receiver 48 of the base 40, removing a screw cap, or disassembling the base. The user lets the device lay on the ground 270 when not performing exercise motions. Alternately, where the telescoping pole 30 is fixed to the base 40 and/or a rest device is placed onto the base 40 to hold the telescoping pole 30 upright, the device may be stored with the telescoping pole 30 inserted and in an upright position when not in use.

One way to use the exercise device begins with the user, or a person assisting the user, leveraging the device into an upright position. From that position, the user places their hand or hands on the handle 10 in their desired grip orientation, for example with a hand on top of the handle or by placing a hand each on side of the handle, and then begins moving the device in the desired exercise motion. Exercise motions that a user may perform using the exercise device include leveraging the device back and forth similar to the motion performed with a typical bench press but while moving the weight on the horizontal plane instead of the vertical plane, in a figure-eight motion, in a sweeping motion similar to if the user had a kitchen broom, and in a semi-circle using the user's should as the pivot point.

Figure 10:
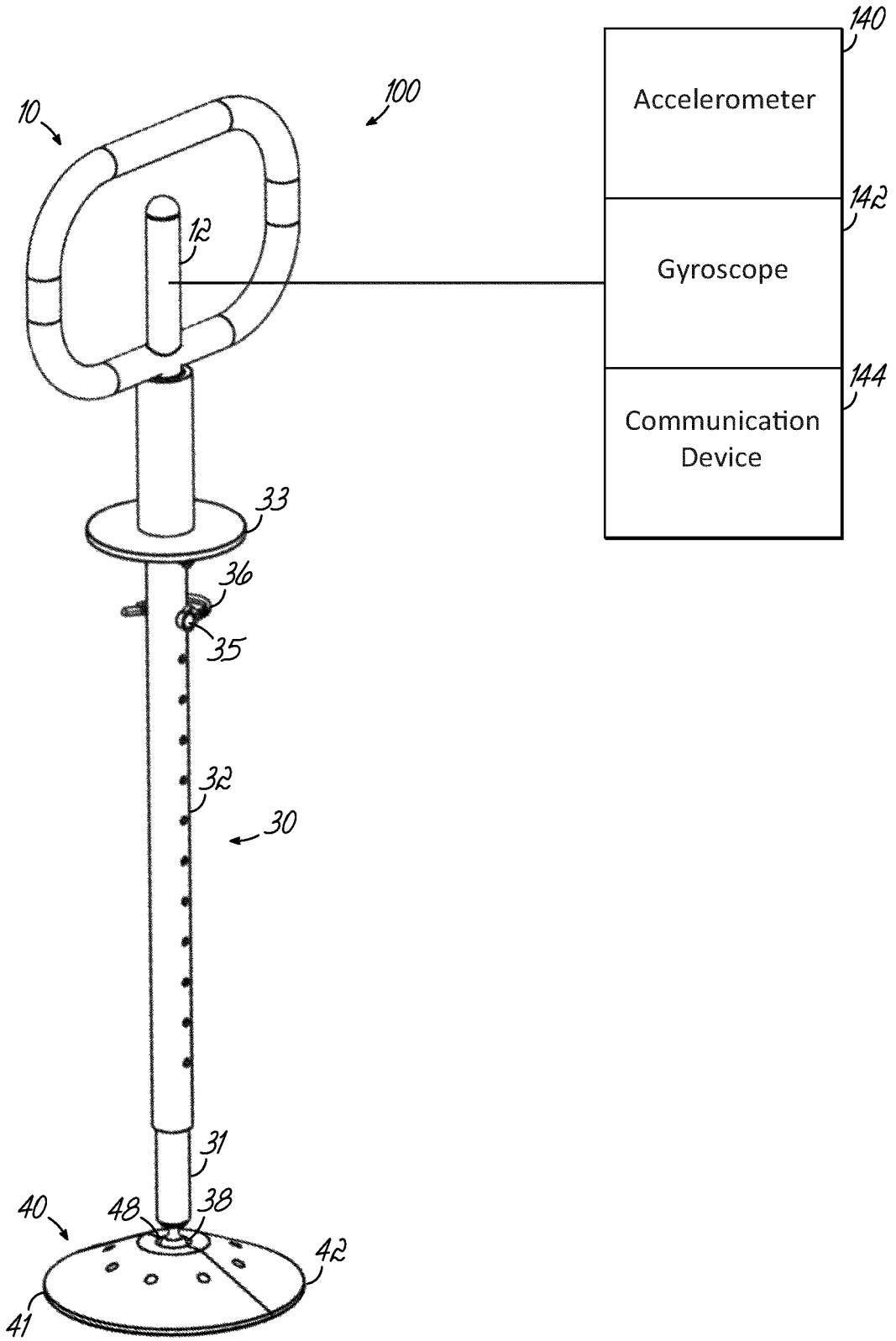
FIG. 10 shows a schematic diagram of an exemplary exercise device including data tracking and communication capabilities.

FIG. 10 shows an example the exercise device of FIG. 1 having an accelerometer 140, a gyroscope 142, and a communication device 144 in the rod portion 12 of the handle 10. These elements are not required but can provide the user with some useful advantages. In some embodiments, in addition to the sensor modules (namely, the accelerometer 140 and gyroscope 144) listed in FIG. 10, one skilled in the art may incorporate other sensor modules into the device, including a pressure sensor, heartbeat sensor, or temperature sensor in the handle, a proximity sensor in the telescoping pole or the handle to warn the user if the user moves the devices beyond a desirable distance on the horizontal plane, or any other sensor module that provides the user with relevant information about the user's biometric or the exercise motions. In some embodiments, the accelerometer 140, gyroscope 142, and communication device 144 are housed in the telescoping pole 30. In other embodiments, the accelerometer 140, gyroscope 142, and communication device 144 are housed in an exterior box that is mounted to the exercise device's handle 10, telescoping pole 30, or base 40.

The accelerometer 140 of FIG. 10 is included in the exercise device so that a user may review and adjust their exercise motions to reach a desired outcome. The gyroscope 142 of FIG. 10 is included in the exercise device to relay information of the exercise device's orientation during use. The communication device 144 is included in the exercise device to transmit information from measuring or recording devices, such as the accelerometer 140 and gyroscope 142 of FIG. 10, to an external device that displays the information. The communication device uses wireless communication methods such as Bluetooth technology, radio frequency, infrared communication, or similarly suited methods that transmit information to an external receiver that records, displays, or records and displays information. The measurement devices listed in FIG. 10 are only representative of the type of devices one skilled in the art could incorporate into the exercise device. In other embodiments, one skilled in the art may include devices that measure the duration of the exercise, the number of repetitions, the displacement of the handle, the pulse and heartrate of the user, or other desirable metrics. In yet additional embodiments, measurement and recording devices transmit their data to a display that is mounted to the exercise device.

Figure 11:
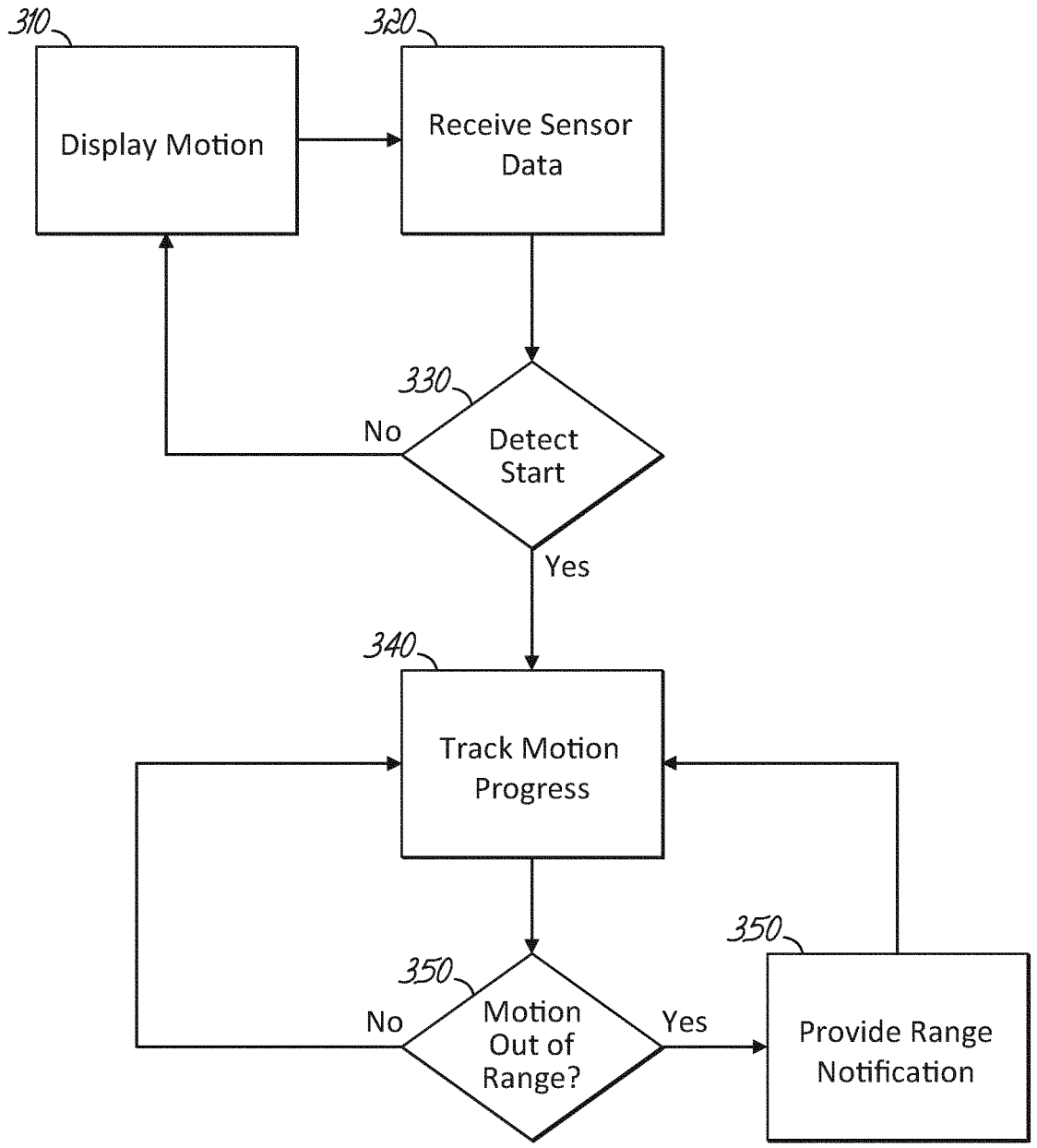
FIG. 11 shows a flowchart of an exemplary set of steps that may be performed to gather and use data from the exercise device of FIG. 10.

FIG. 11 shows an exemplary set of steps that may be performed to gather and use information from sensor enabled exercise devices. Use of the device may be paired with a smartphone or other device by Bluetooth or other wireless communication. During use, the smartphone may display 310 a motion or exercise to be performed by the user with the exercise device based upon a user configured exercise routine, exercise goal, injury rehabilitation goal, or other configured goal. The user may perform the displayed 310 motions with the exercise device while sensor data is received 320 based upon the performed motions (e.g., accelerometer and gyroscope data indicating the speed of movements, directions of movements, changing orientations of the handle, etc.).

When information is received indicating that a displayed 310 exercise has been started 330, such information may be tracked and analyzed by a processor of the exercise device or a processor of a user device in communication with the exercise device. The tracked 340 motions may be analyzed to determine whether, based upon sensor data, the user is performing the displayed 310 exercise safely and accurately, or whether they are performing motions too quickly, too slowly, in the wrong direction, or otherwise outside of a safe or desired range of motion and activity.

Where tracked 340 data indicates that a user is performing exercises that are out of range 340 (e.g., the detected exercises do not match the desired displayed 310 exercises), the exercise device or user device may generate 360 a notification indicating that the user is not performing the displayed 310 exercise in an ideal manner, and may also provide additional instruction (e.g., audio, video, pictorial, textual) that indicates how the performed exercises are not idea, and/or how to adjust the performance of exercises to reach an ideal motion.

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

The invention claimed is:

1. An exercise device comprising:

a base comprising a receiver on a top of the base and a bottom opposite the receiver, the base including a set of detachable plates forming the receiver and a bottom plate adapted to couple with and statically position the set of detachable plates relative to the bottom plate;

a telescoping pole comprising an inner pole and a sheath, wherein:

the inner pole comprises a base connector on a bottom end, the sheath is adapted to retain one or more weights and receive the inner pole, the inner pole and the sheath are adapted to couple to each other to produce the telescoping pole with a desired length, a handle comprising a grip portion extending from a handle pole, wherein the handle pole is adapted to be inserted into and coupled the sheath; and the base connector is adapted to be inserted into and movably engaged with the receiver on the top of the base.

2. The exercise device of claim 1, wherein the sheath comprises one or more sheath holes and the inner pole comprises one or more fastener holes, the telescoping pole further comprising a fastener adapted to be inserted through a set of aligned holes of the sheath and the inner pole to fix the telescoping pole at the desired length.

3. The exercise device of claim 1, wherein the grip portion comprises a loop grip and a post grip.

4. The exercise device of claim 2, wherein the coupling of the base connector that is adapted to be movably engaged with the telescoping pole is selected from the group consisting of a removable ball and socket joint, a fixed ball and socket joint, and a hinged joint.

5. The exercise device of claim 1, wherein the base connector comprises a spherical bearing, and wherein a diameter of a rim of the receiver of the base is less than a diameter of the spherical bearing of the inner pole of the telescoping pole such that the spherical bearing is not removable from the receiver.

6. The exercise device of claim 1, wherein the diameter of a rim of the receiver of the base is greater than the diameter of the spherical bearing of the inner pole of the telescoping pole such that the spherical bearing is freely insertable and removable from the receiver.

7. The exercise device of claim 1, further comprising a cover adapted to attach to the base and hold the base connector within the receiver.

8. The exercise device of claim 7, wherein the cover acts as a locking mechanism adapted to couple with the base and the telescoping pole and hold the telescoping pole at a neutral position substantially centered above the base.

9. The exercise device of claim 1, wherein the handle further comprises at least one sensor module, and wherein the at least one sensor module is configured to produce a set of exercise data during use of the exercise device and transmit the set of exercise data to a user device.

10. The exercise device of claim 9, wherein the at least one sensor module is configured to detect a movement of the handle outside of a configured safe range of motion and, in response, cause a notification to be provided to the user.

11. The exercise device of claim 1, wherein the sheath comprises a platform adapted to receive and hold one or more weight plates so that horizontal movement of the weight plates is substantially prevented.

12. The exercise device of claim 11, wherein the platform is slideably positioned on the sheath and is adapted to be coupled to the sheath at a desired position along a length of the sheath.

13. The exercise device of claim 1, wherein the telescoping pole is adapted to allow the desired length to be between about three feet and about six feet.

14. The exercise device of claim 1, further comprising a baseplate and a second base, wherein the baseplate is adapted to couple to and statically position the base and the second base relative to the baseplate, wherein the second base is adapted to receive a second base connector of a second exercise device.

15. A method of using an exercise device comprising:

coupling an inner pole with a sheath to form a telescoping pole of a desired length;

placing one or more weights on a platform of the sheath, wherein the platform is adapted to hold the one or more weights and substantially prevent horizontal movements;

coupling a handle with the sheath, wherein the handle is adapted to be gripped by a user and prevent the one or more weights from moving from the platform;

inserting a spherical bearing of the inner pole into a receiver of a base, wherein the base comprises a foot portion that contacts the floor;

performing a set of exercises by gripping the handle and moving the handle in one or more directions while the base remains statically positioned;

attaching a locking mechanism to the base and the telescoping pole after inserting the spherical bearing, the locking mechanism being adapted to hold the telescoping pole within a neutral position centered above the base;

removing the handle from the sheath;

changing the number of the one or more weights on the platform while the telescoping pole remains within the neutral position centered above the base;

reattaching the handle to the sheath;

removing the locking mechanism; and performing additional exercises with a new weight of the one or more weights.

16. The method of claim 15, further comprising receiving a description of a set of exercises appropriate for rehabilitation of a specific injury, and performing the set of exercises by moving the handle in one or more directions based on the set of exercises appropriate for the specific injury.

17. The method of claim 15, further comprising attaching a cover to the base after inserting the spherical bearing, wherein the cover is adapted to prevent removal of the spherical bearing from the receiver.

* * * * *